US007766705B2

(12) United States Patent
Jordan

(10) Patent No.: US 7,766,705 B2
(45) Date of Patent: Aug. 3, 2010

(54) CONNECTOR ARRANGEMENT

(75) Inventor: Peter Jordan, Hants (GB)

(73) Assignee: ITT Manufacturing Enterprises, Inc., Wilmington, DE (US)

( * ) Notice: Subject to any disclaimer, the term of this patent is extended or adjusted under 35 U.S.C. 154(b) by 0 days.

(21) Appl. No.: 12/290,099

(22) Filed: Oct. 27, 2008

(65) Prior Publication Data

US 2009/0156033 A1 Jun. 18, 2009

(30) Foreign Application Priority Data

Nov. 13, 2007 (GB) ..... 0722273.0

(51) Int. Cl.
*H01R 13/05* (2006.01)

(52) U.S. Cl. ..... 439/825; 439/675; 439/916

(58) Field of Classification Search ..... 439/63, 439/578, 825, 675
See application file for complete search history.

(56) References Cited

U.S. PATENT DOCUMENTS 5,004,438 A * 4/1991 Cabourne ..... 439/825
5,011,438 A * 4/1991 Awbrey ..... 439/825
5,115,563 A * 5/1992 Wilson ..... 29/876
5,391,097 A * 2/1995 Kerul ..... 439/825
5,397,253 A * 3/1995 Fries ..... 439/825
5,624,278 A * 4/1997 Kuroda et al. ..... 439/675
5,641,294 A * 6/1997 Beard ..... 439/247
6,099,322 A * 8/2000 Beloritsky et al. ..... 439/63
6,142,788 A * 11/2000 Han ..... 439/63
6,227,868 B1 * 5/2001 Wlodarski ..... 439/63
6,319,016 B1 * 11/2001 Juntwait ..... 439/63

* cited by examiner

*Primary Examiner*—Hien Vu
(74) *Attorney, Agent, or Firm*—Peter Van Winkle

(57) ABSTRACT

A connector arrangement comprises a rigid inner conductor (107), a dielectric sleeve (111) arranged around the inner conductor and a rigid outer conductor (109) arranged around the sleeve. A surface of at least one of the inner conductor, the sleeve and the outer conductor is provided with a taper, such that the sleeve fixes the relative transverse positions of the inner and outer conductors at a first end of the arrangement and not at a second end of the arrangement. The inner conductor is longitudinally slidable relative to the outer conductor. Such an arrangement is suitable for use in hostile environments, such as in high temperature pipelines, in which there are large temperature variations and in which the positional variation of mating connectors is high.

4 Claims, 3 Drawing Sheets

FIG. 3A
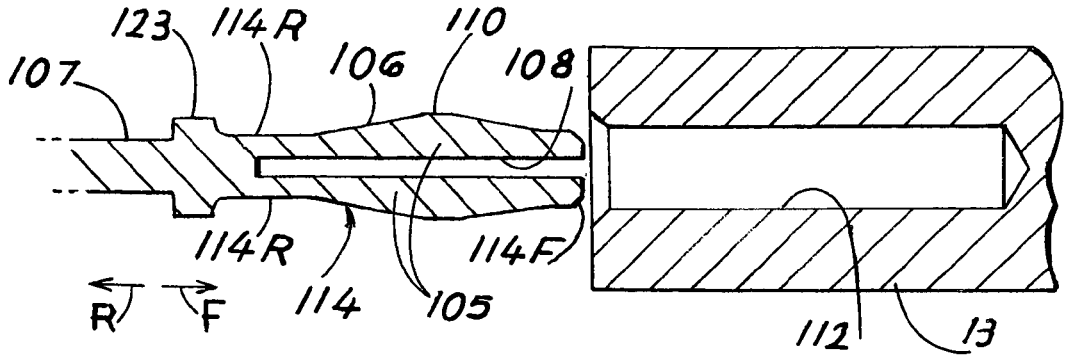
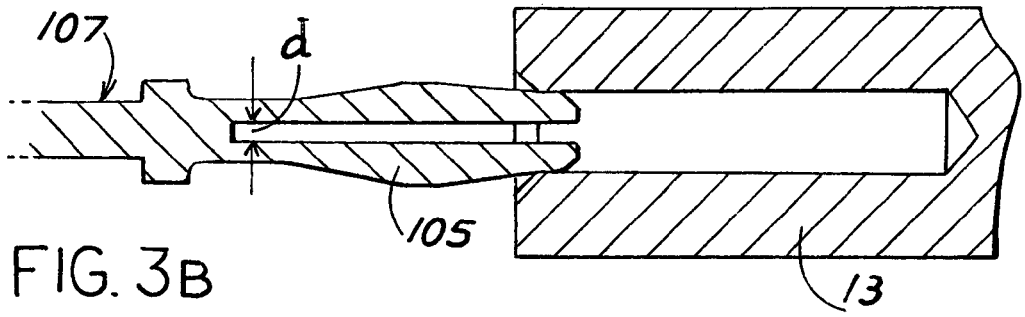
FIG. 3B
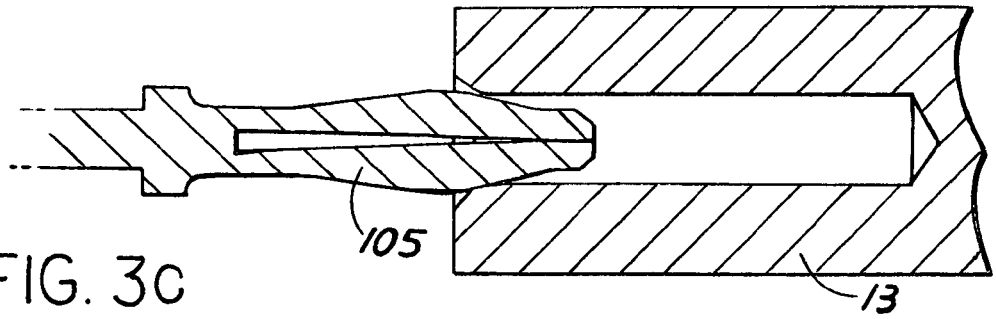
FIG. 3C
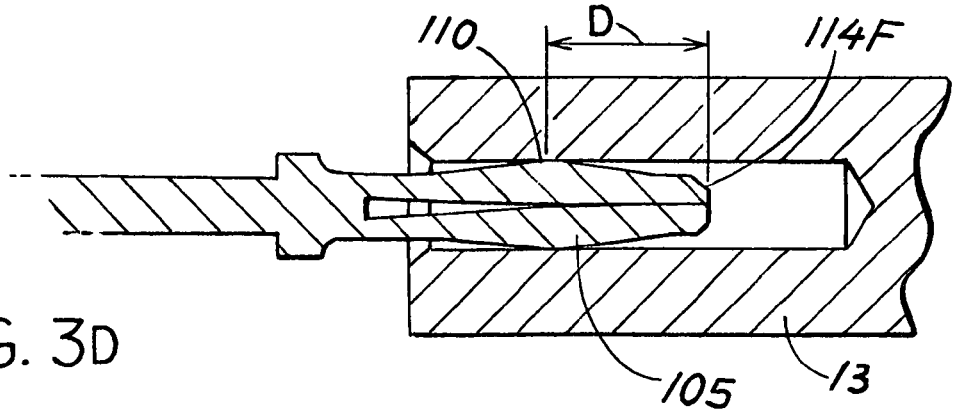
FIG. 3D

CONNECTOR ARRANGEMENT

CROSS-REFERENCE

Applicant claims priority from Great Britain patent application GB 0722273.0 filed 13 Nov., 2007.

BACKGROUND OF THE INVENTION

This invention relates to a connector arrangement having an inner conductor and an outer conductor. In particular, this invention relates to a connector arrangement of this type which is suitable for use in hostile environments subject to large temperature variations and/or in applications in which there is significant variation in the relative positions of the components of mating connectors.

Connectors having separate inner and outer conductors, such as coaxial connectors, may be used to provide a shielded connection between passive or active electrical and electronic elements.

Frequently, such connectors are used in hostile environments which are subject to large temperature variations and in applications in which the positional variation of mating connectors is high. An example of such an environment is a high temperature pipeline monitoring arrangement, whereby an antenna embedded in the wall of a pipeline is connected to electronic monitoring equipment. Such an arrangement may operate at temperatures of up to 250° C. for prolonged periods of time.

There is thus a need for connectors for use in such applications, which connectors are preferably capable of providing reliable electrical connections.

SUMMARY OF THE INVENTION

According to a first aspect of the invention, there is provided a-connector arrangement comprising a rigid inner conductor, a dielectric sleeve arranged around the inner conductor and a rigid outer conductor arranged around the sleeve, wherein a surface of at least one of the inner conductor, the sleeve and the outer conductor is provided with a taper, such that the sleeve fixes the relative transverse positions of the inner and outer conductors at a first end of the arrangement and not at a second end of the arrangement, and wherein the inner conductor is longitudinally slidable relative to the outer conductor.

The invention thus provides a connector arrangement which can accommodate both longitudinal and transverse misalignment of mating connectors, and which can cope with the differential expansion of components as caused by temperature variations in materials having different temperature coefficients of expansion.

In relation to the invention, the term "longitudinal" refers to a direction substantially parallel to the main axis of the inner conductor. The term "transverse" refers to any direction substantially perpendicular to the main axis of the inner conductor.

The first end of the connector arrangement is typically for connection to a coaxial cable terminated in a conventional connector. In this case, the inner conductor may terminate in a compliant socket and the outer conductor may terminate in a threaded sleeve.

The second end of the connector arrangement is for connection to one or more conductors of a mating connector which may be misaligned relative to each other or other components such as housings and casings. The misalignment may be longitudinal, transverse, or both longitudinal and transverse.

The inner conductor is slidable within the outer conductor, and this allows for their relative longitudinal positions to be adjusted to suit the mating connector.

The inner and outer conductors may be coaxially arranged at the first end of the arrangement, and held in this arrangement by the interposed dielectric sleeve. The inner conductor, and optionally also the dielectric sleeve, have a floating transverse arrangement relative to the outer conductor at the second end of the arrangement. It is this floating arrangement which allows for the transverse misalignment mentioned above.

The inner and outer conductors are preferably reversibly separable, i.e. they may be separated and then reassembled. Thus, the inner conductor may initially be coupled to the mating connector in isolation, with the sleeve and outer conductor subsequently being assembled over the inner conductor. The dielectric sleeve may be permanently attached to the outer conductor for this purpose. The outer conductor may or may not be arranged for coupling to the mating connector.

In preferred embodiments, the inner conductor is provided at the second end of the arrangement with a plurality of longitudinal connector elements having resilience in a transverse direction. These connector elements provide for electrical and mechanical coupling of the inner conductor with the mating connector, particularly a cylindrical bore of the mating connector. Specifically, in the coupled configuration, the connector elements resiliently bear in transverse directions against the wall of the cylindrical bore.

The connector elements may define a split pin arrangement, such as a bifurcated split pin arrangement. In this case, the connector elements are arranged to bear in opposite directions against the wall of the cylindrical bore of the mating connector.

The connector elements may have an outwardly curved, or barreled, outer surface for defining a single longitudinal point of contact with the wall of the cylindrical bore of the mating connector. In this way, the pressure applied by the connector elements is maximised to ensure a reliable electrical connection. Such an outer surface also allows for angular misalignment with the mating connector.

The connector elements may be transversely spaced apart in their unbiased configuration, and are arranged such that they may be biased directly against each other, particularly so that their distal ends bear against each other. In this way, the force with which the outer surfaces bear on the wall of the cylindrical wall of the mating connector may be maximised.

The inner conductor may be further provided, at or near the second end of the arrangement, with a transverse flange for longitudinally locating the inner and/or outer conductor. Similarly, the outer conductor may be provided, at the first end of the arrangement, with a transverse flange for mounting the arrangement to a housing or enclosure.

The invention also provides an antenna connector and a pipeline antenna connector comprising the connector arrangement described above.

Also disclosed is a pipeline antenna assembly comprising: an insert for mounting in a wall of a pipe; an antenna mounted in a surface of the insert; and the connector arrangement described above, wherein the inner conductor is connected at the second end of the arrangement to the antenna.

The pipeline antenna assembly is for mounting in the wall of a pipeline, such as a high temperature pipeline, such that the antenna is able to transmit and/or receive signals travelling within the pipeline.

According to a second aspect of the invention, there is provided a method of coupling a connector arrangement to a mating connector, the method comprising: coupling a rigid inner conductor to a conductor of the mating connector; and assembling a dielectric sleeve and a rigid outer conductor around the inner conductor such that the sleeve is interposed between the inner and outer conductors, wherein a surface of at least one of the inner conductor, the sleeve and the outer conductor is provided with a taper, such that the sleeve fixes the relative transverse positions of the inner and outer conductors at a first end of the arrangement and not at a second end of the arrangement.

The connector arrangement in the second aspect may be the connector arrangement of the first aspect described above.

The novel features of the invention are set forth with particularity in the appended claims. The invention will be best understood from the following description when read in conjunction with the accompanying drawings.

DESCRIPTION OF THE DRAWINGS

A specific embodiment of the invention will now be described, by way of example only, with reference to the accompanying drawings, in which:

FIGS. 3A to 3D are cross sectional views for explaining the process by which the connector arrangement shown in FIGS. 1 and 2 is coupled with a mating connector.

DESCRIPTION OF THE PREFERRED EMBODIMENT

The invention provides a connector arrangement comprising a rigid inner conductor, a dielectric sleeve arranged around the inner conductor and a rigid outer conductor arranged around the sleeve. A surface of the inner conductor, the sleeve and/or the outer conductor is provided with a taper, such that the sleeve fixes the relative transverse positions of the inner and outer conductors at a first end of the arrangement and not at a second end of the arrangement. In this way, the inner conductor can cope with transverse misalignment in corresponding conductors of mating connectors. The inner conductor is longitudinally slidable relative to the outer conductor, so as to allow for longitudinal misalignment between corresponding conductors of mating connectors.

The invention also provides a method for coupling the connector arrangement with a mating connector.

Figure 1:
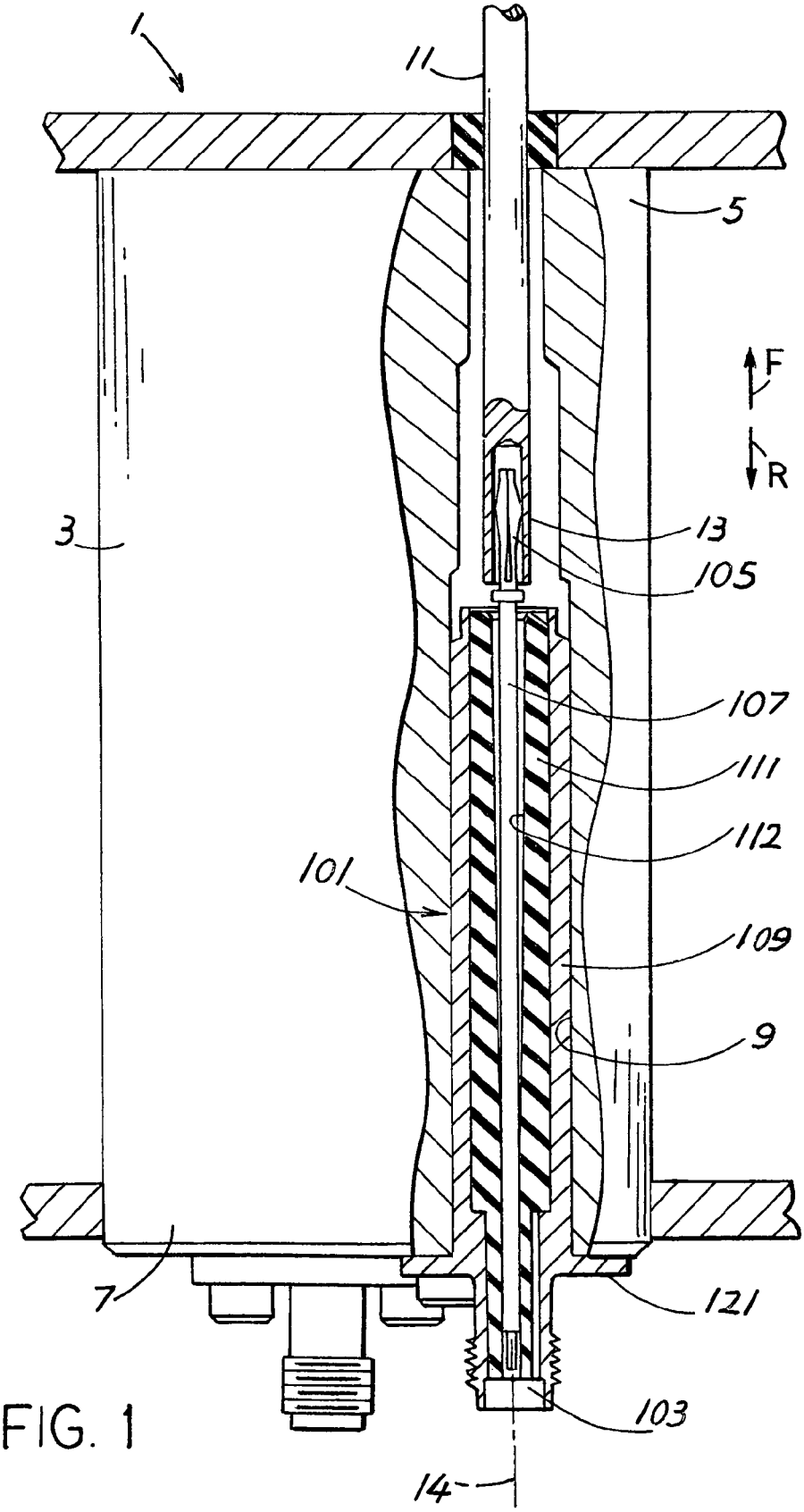
FIG. 1 is a cross sectional view of a pipeline antenna assembly which includes a connector arrangement according to the invention.

FIG. 1 is a cross sectional view of a pipeline antenna assembly 1 comprising a connector arrangement 101 according to the invention. The assembly 1 forms part of a pipeline monitoring system, which system may be provided for determining the content of the pipeline and its flow rate.

The assembly 1 comprises a substantially cylindrical insert 3 for mounting in the wall of a pipeline. The insert 3 is arranged such that, once installed in the pipeline, its front F end 5 is substantially flush with an inner surface of the pipeline wall and its rear R end 7 is substantially flush with the outer surface of the pipeline.

The insert 3 is formed as a solid metal component through which a cylindrical bore 9 is provided. The cylindrical bore 9 extends the full length of the insert 3 from the front end 5 to the rear end 7 and is provided for accommodating certain components of the pipeline monitoring system.

In particular, an antenna 11 is mounted within the cylindrical bore 9 at the front end 5 of the insert 3. The antenna 11 is mounted in the bore 9 such that it projects from the front end 5 of the insert 3 to enable signals to be transmitted and/or received in the pipeline. The antenna 11 is hermetically sealed into the bore 9 with a glass bead. A rear end of the antenna 11 is itself provided with a cylindrical bore 13 to serve as a connector for the antenna 11.

By reason of its installation process, the longitudinal (parallel to axis 14) and transverse (radial to axis 14) positioning of the antenna 11 within the cylindrical bore 9 varies significantly between different assemblies 1. For this reason, and by reason of the depth of the antenna 11 within the bore 9, it is not generally possible to couple conventional electrical cables directly to the antenna connector in bore 13.

Accordingly, the insert 3 is additionally provided with the connector, arrangement 101 according to the invention. The connector arrangement 101 is mounted to the insert 3 and at one end provides an electrical connection to the antenna connector 13 and at its other end is terminated with a coaxial connector 103 for the antenna 11, which connector 103 is externally mounted to the rear R end 7 of the insert 3.

The externally mounted coaxial connector 103 thus provides a convenient means for coupling conventional electrical cables (not shown) to the antenna 11 shown.

The mounting position of the coaxial connector 103 is fixed relative to the cylindrical bore 9, and does not vary between different assemblies 1. Since the position of the antenna 11 within the cylindrical bore 9 varies significantly between different assemblies 1 (see above), one of the functions of the connector arrangement 101 is to accommodate variations in the relative positions of the antenna 11 and the coaxial connector 103.

Figure 2:
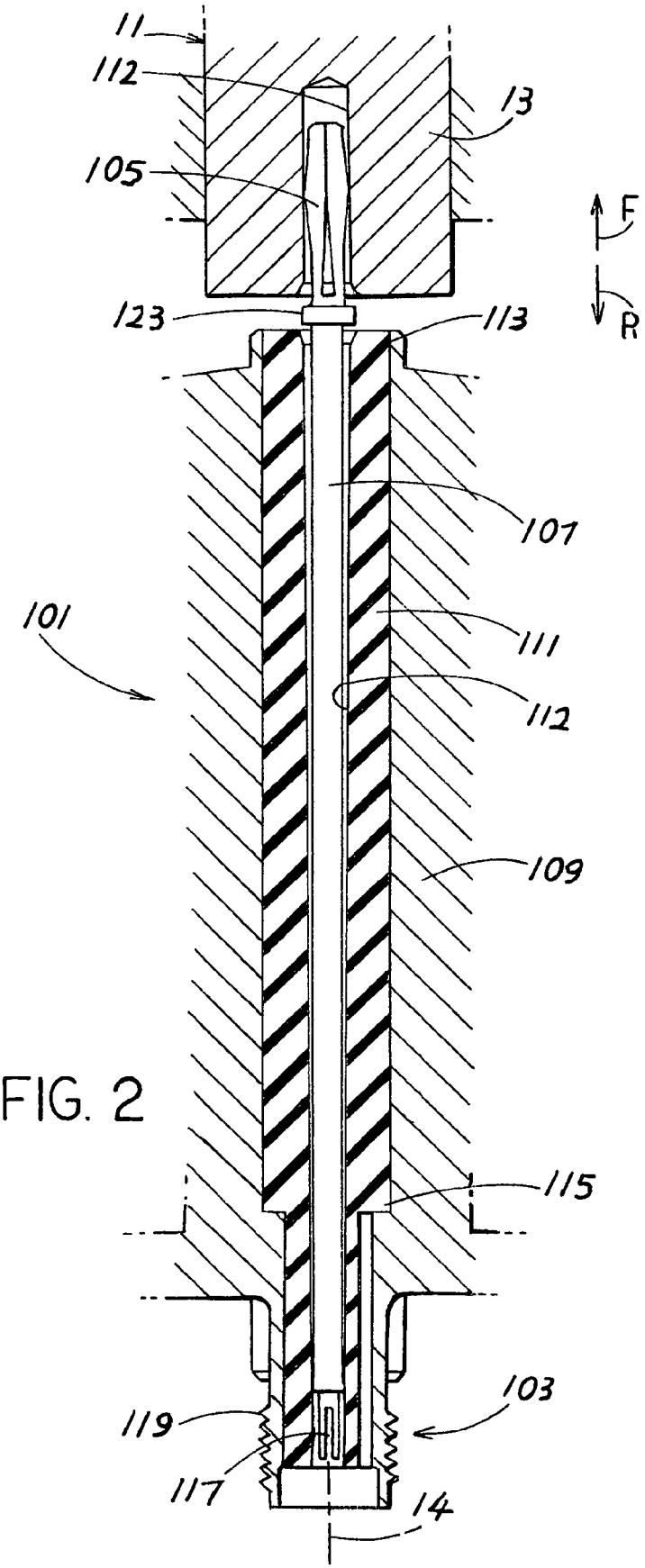
FIG. 2 is a detailed cross sectional view of the connector arrangement shown in FIG. 1.

The connector arrangement 101 is shown in more detail in FIG. 2, which is a cross sectional view. A first end of the arrangement 101 is provided with the coaxial connector 103 and a second end of the arrangement 101 is provided with a pair of connector elements 105 for connection to the antenna connector 13.

Referring to FIG. 2, the connector arrangement 101 comprises a cylindrical inner conductor 107 and a tubular outer conductor 109 (not fully shown) each formed of a metallic material. Interposed between the inner and outer conductors 107, 109 is a dielectric sleeve 111 which physically separates the conductors 107, 109. The surfaces of the inner and outer conductors 107, 109 and the dielectric sleeve 111 each have a circular cross section.

An inner surface or bore 112 of the dielectric sleeve 111 is provided with a straight taper, such that its diameter is greater at the front end of the arrangement 101 than at the rear end of the arrangement 101 and it is gradually tapered between its ends. Consequently, the dielectric sleeve 111 maintains the inner and outer conductors 107, 109 coaxially at the rear end of the arrangement 101, while the axis of the inner conductor 107 is allowed to float somewhat relative to the axis of the outer conductor 109 at the front end of the arrangement 101.

The dielectric sleeve 111 and the outer conductor 109 are mechanically coupled such that they are not movable relative to each other. In particular, steps 113, 115 formed in their facing surfaces cooperate to prevent relative longitudinal movement.

In contrast, the dielectric sleeve 111 and the inner conductor 107 are not mechanically coupled to fix their relative longitudinal positions. Thus, the inner conductor 107 is slidably arranged within the dielectric sleeve 111.

As mentioned above, the rear end of the arrangement 101 is provided with a coaxial connector 103. The coaxial connector 103 comprises a compliant socket 117 formed out of an end of the inner conductor 107 and a threaded sleeve 119 formed out of the end of the outer conductor 109. The threaded sleeve 119 protrudes beyond the dielectric sleeve 111.

The first end of the arrangement 101 is also provided with a circumferential flange 121 (shown only in FIG. 1) for mounting the arrangement 101 to the insert 3. The flange 121 is part of the outer conductor 109.

The front end of the arrangement 101 is provided with a pair of connector elements 105 in the form of a bifurcated split pin for connection to the antenna connector 13. The connector elements 105 are formed out of an end of the inner conductor 107 and protrude beyond the dielectric sleeve 111 and the outer conductor 109. The protruding portion of the inner conductor 107 is also provided at the second end of the arrangement with a circumferential flange 123 for use in longitudinally locating the outer conductor 109.

The connector elements 105 of the connector arrangement 101 are shown in more detail in FIGS. 3A to 3D, which are cross sectional views. As mentioned above, the connecting elements 105 are in the form of a bifurcated split pin. The elements 105 thus extend in the longitudinal direction and are transversely spaced apart. The outer surfaces 106 of the elements 105 define an outwardly curved or barreled surface, with diameters tapering to be of progressively smaller diameter both forward F and rearward R of a largest diameter location 110. The inwardly facing surfaces 108 of the elements 105 define parallel flat surfaces. The barreled outer surface provides for a reliable electrical connection and accommodates angular misalignment between the connector elements 105 and the primarily cylindrical bore 112 of the antenna connector 13. Rear ends 114R of halves 114 of the elements are separated by a distance d.

The front ends 114F of the elements 105 are provided with chamfered outer edges for guiding the elements 105 into the antenna connector 13, as shown in FIGS. 3A and 3B.

The connector elements 105 are shaped such that when they are inserted into the antenna connector 113, they are resiliently urged towards each other by the wall of the mating connector, so that they apply an opposite transverse force on the wall of the antenna connector 113, as shown in FIGS. 3B and 3C. The elements 105 are also arranged such that they continue to be urged towards each other after their distal ends have touched, as shown in FIG. 3D. In this way, the elements 105 may apply very high forces on the wall of the antenna connector 113. There is a longitudinal distance D between the largest diameter locations 110 of the connector and their front ends 114F where D is a plurality of times as great as d.

In use, the inner conductor 107 (FIG. 2) of the arrangement 101 is initially separated from the dielectric sleeve 111 and the outer conductor 109. The inner conductor 107 is then inserted front end first, into the cylindrical bore 9 (FIG. 1) of the insert 3. The connector elements 105 enter the antenna connector 13, as shown in FIGS. 3A and 3B, and engage with the wall of the antenna connector 13, as shown in FIGS. 3C and 3D.

The inner conductor 107 is located longitudinally using the rear end 7 (FIG. 1) of the insert 3 as a datum, and the resilience of the connector elements 105 (FIG. 3D) maintains the inner conductor 107 in this location.

Subsequently, the dielectric sleeve 111 (FIG. 2) and the outer conductor 109, which are mechanically coupled to each other, are assembled around the inner conductor 107 by sliding them over the inner conductor 107. The outer conductor 109 is located longitudinally using the circumferential flange 123 extended from the inner conductor 107 at the front end of the arrangement 101, and using the circumferential flange 121 (FIG. 1) extended from the outer conductor 109 at the first end of the arrangement 101 to limit insertion depth.

The circumferential flange 121 extended from the outer conductor 109 at the first end of the arrangement 101 is then mechanically attached to the rear end 7 of the insert 3 using screw fasteners, so as to transversely and longitudinally locate the first, or rear end of the connector arrangement 101.

Any transverse misalignment between the first end of the connector arrangement 101 and the connector elements 105 at the second end of the arrangement 101 is accommodated by the taper in the dielectric sleeve 111. The sleeve passage 112 has a taper angle that is continuous and that has an angle of no more than 3°.

Specific embodiments of the invention have been described. However, those skilled in the are will appreciate that various changes may be made to the without departing from the scope of the invention, as defined by the claims.

For example, in the connector arrangement described above, the first end is provided with a coaxial connector having a compliant socket and a threaded outer sleeve. However other connectors, such as non-threaded connectors, may alternatively be provided.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A connector arrangement comprising a rigid elongated inner conductor that has an axis extending in a longitudinal direction and that has opposite first and second inner conductor ends, an elongated dielectric sleeve arranged around the inner conductor and having opposite first and second sleeve ends, and a rigid outer conductor arranged around the sleeve, said inner conductor having an outer surface and said sleeve having an inner surface that lies adjacent to and faces said outer surface of said inner conductor, when the inner conductor is fully installed on the sleeve, wherein:

of said outer and inner surfaces, at least one of said surfaces has a taper with a narrowest end that fixes the relative transverse positions of the inner conductor and sleeve at said conductor and sleeve first ends;

the inner conductor is provided at the inner conductor second end with a split pin that has a pair of pin parts that are biased apart and that have free front ends, said split pin having a widest part spaced a distance (D) rearward of said free front ends; and including a mating connector having a bore that receives said split pin widest part and presses said pin parts thereat toward each other to press said free front ends into firm contact with each other;

said pin parts have facing surfaces that are flat and parallel when not lying in said mating connector.

2. A connector arrangement according to claim 1, wherein:

said at least one surface which has a taper, has a taper of no more than 3 along a majority of the length of said inner conductor that lies within said sleeve.

3. A connector arrangement according to claim 1, wherein the inner conductor has a floating transverse arrangement relative to the outer conductor at the second end of the inner conductor and sleeve along a distance along said axis.

4. A connector arrangement which includes a conductor and a mating connector that has a bore that receives a front end of said conductor, and wherein:

said conductor front end is in the form of a split pin that forms a plurality of axially-elongated connector parts with fixed rear ends that are separated and with front ends that are initially separated and that are deflectable towards each other and that have flat surfaces that face each other, said connector parts lying in said mating connector bore, said connector parts forming an outer surface with a greatest diameter location that engages walls of said bore and with connector part locations lying forward and rearward of said greatest diameter location which are of smaller diameters than said greatest diameter location, said connector element front ends being compressed into engagement with each other by the compression, by said bore walls, of said greatest diameter location of said inner connector front ends;

said connector element front ends have flat surfaces that are parallel and face each other and that are pressed against each other by said compression of said inner connector front ends.

* * * * *